United States Patent [19]

Mora

[11] Patent Number: 4,778,052

[45] Date of Patent: Oct. 18, 1988

[54] PACKAGING SYSTEMS FOR A HABITUATION-FREE USE OF PRODUCTS FOR TOPICAL APPLICATION SUCH AS EMULSIONS, CREAMS, UNGUENTS, PASTES, SALVES, GELS, LIPOGELS AND THE LIKE

[76] Inventor: Valtiero Mora, Via Zamboni, 97, 25100 Brescia, Italy

[21] Appl. No.: 76,608

[22] Filed: Jul. 23, 1987

[51] Int. Cl.[4] ..... B65D 83/00

[52] U.S. Cl. ..... 206/438; 206/524.1; 222/92

[58] Field of Search ..... 206/216, 219, 220, 221, 206/222, 277, 524.1, 526, 527, 438; 222/92, 99

[56] References Cited

U.S. PATENT DOCUMENTS

| | | | |
|---|---|---|---|
| 1,760,773 | 5/1930 | Penny | 206/216 |
| 2,176,923 | 10/1939 | Nitardy | 206/221 |
| 2,862,616 | 12/1958 | Capozzi et al. | 206/219 |
| 3,197,071 | 7/1965 | Kuster | 206/277 |
| 3,478,871 | 11/1969 | Sager | 206/221 |
| 4,588,080 | 5/1986 | Ginn | 206/219 |

FOREIGN PATENT DOCUMENTS

| | | | |
|---|---|---|---|
| 020052 | 7/1908 | Fed. Rep. of Germany | 206/219 |
| 2939116 | 4/1981 | Fed. Rep. of Germany | 206/219 |
| 1209359 | 9/1959 | France | 206/219 |
| 0032130 | 3/1978 | Japan | 206/277 |

*Primary Examiner*—Jimmy G. Foster
*Attorney, Agent, or Firm*—DeLio & Associates

[57] ABSTRACT

Packing system of products for topical application such as emulsions, creams, unguents, pastes, salves and so on, which avoids the phenomenon of the habitation and provides the arrangement in layers in the same container of two or more products, either in different or equal amount but of different composition and/or concentration of active substances which may be of different type, appearance, color and so on and aim at the same either dermatological or cosmetic or pharmaceutical purpose.

The products arranged in layers are delivered and used one after the other in order to either alternate their application or to use progressively increasing concentrations in order to avoid the habituation in case of either continuous or periodic applications.

6 Claims, 1 Drawing Sheet

PACKAGING SYSTEMS FOR A HABITUATION-FREE USE OF PRODUCTS FOR TOPICAL APPLICATION SUCH AS EMULSIONS, CREAMS, UNGUENTS, PASTES, SALVES, GELS, LIPOGELS AND THE LIKE

This invention relates to a packing system of products for topical application such as emulsions, creams, unguents, pastes, salves, gels, lipogels and the like, that provides to arrange two or more products, either in different or equal amount but in various confection and/or doses of substances or active components, in distinct layers, in the same container. Such substances or active components may be of different type, appearance colour etc. yet having the same dermatological, cosmetic and pharmaceutical aim.

The products arranged in distinct layers are distributed and applied consecutively in order to alternate the use thereof or to utilize them in progressively increasing concentrations to avoid habituation in periodic or cyclic applications.

In the field of dermatology, cosmetic and medical surgical aids it is common to use products for topical applications such as emulsions, creams, unguents, pastes, salves, gels, lipogels, and the like. Unfortunately these products for topical use, containing active components often give rise to a worrying, at sight not explicable phenomenon.

This is the case, for example, for dermatological and cosmetic products. In fact it happens that many consumers continually using functional dermocosmetic products containing active cosmetic substances such as to promote eudermic effects, like for instance hydrating, nourishing, bioregenerating products for hardening and rejuvenating the skin and products for the body, notice after an appreciable initial improvement that the signs of further getting better cease completely, although they constantly and protractdely continue using the same products. This results more evident and stronger especially when effective and complete products are used.

This phenomenon well-known in the pharmacological, biochemical field should be explained by the habituation or addiction to substances, i.e. a particular form of adaption of the living organism which is common to all human being and is established more or less slowly as a defence of the organism itself against exterior agents in case of repeated and constant giving of heterogeneous substances as well as biologically and pharmacologically active principles, whereby the living organism becomes always less and less sensitive and reactive to such substances and requires even greater and progressively increasing doses of such active principles to achieve and keep steady the same effects and responses.

The functional cosmetic products can be grouped in two classes:

(a) products of continuous and daily use, like for example day and night creams; and (b) superactive shock products of periodic or cyclic use.

Products of continuous use, which are daily applicated too long and are composed of substances having essentially always the same concentration, cause in the cells of the skin a phenomenon socalled "biological nausea".

In fact, active principles both of synthetic and animal origin used too long cause in the cells a state of dull reactivity with not yet well-known processes leading to a partial block of bioenzymatic and osmotic systems governing the adsorption of such active principles with the consequence of a changed local chemism and an impossible integration of such active principles in the metabolism of the skin.

In such a case, the continuous and protracted use causes the phenomenon of the habituation or addiction to such active principles with the consequence of a decrease first, then a disappearance of the effectiveness of the used product.

The sole, logical, obvious remedy for this defect is alternately using different products which are composed of completely different substances, if possible, belonging to different kingdoms, i.e. vegetable and animal, although they aim at the same cosmetic purpose (for exaple, protective, hydrating, nourishing, regenerating purpose).

With such an extremely rational system, skin is allowed to keep an always live and quick reactivity without the danger of its weakening or extinguishing as it is excited by the alternance of different active products which stimulate it in a different way.

In case of superactive or shock products to be periodically applied, use of active principles, applied in great and always the same doses with the aim at achieving quicker results, causes in the cells after a short initial getting better an undesired phenomenon socalled "biological exhaustion", characterized in that cells cannot keep a long time high levels of unnatural reactivity, whereby after a more or less short period of time the desired eudermic effect does not take place any longer.

The cause of this great defect is the exaustion, block or modification of particular cellular receptors normally exciting the reaction to bioactive stimuli.

In such cases skin should come in contact with greater and greater doses of active principles in order to react again, the peculiar characteristics of the habituation being the establishing of the resistance to the dose and not to the active principle.

Consequently, it is necessary to give greater and greater doses to the organism to achieve the same effect or to stop the treatment for some day to allow the organism to become sensitive to the action of such substances again.

In fact, the habituation usually is only transitory. In this case, when using superactive impact cosmetics to be daily but periodically applied, the most logical remedy to avoid the danger of habituation would be that of applying in each (regenerating, anti-wrinkling, revitalizing, hardening) treatment small and different quantities of product having increasing concentration of the same active principle so as to increasingly grade the doses for the whole treatment.

Starting from such statement the object of this invention is to provide a packing system and a method of using products for topical application in order to advantageously allow the serious phenomenon of the habituation or habit leading to the inefficacy of the used product to be avoided.

Another object of the invention is to place at users' disposal confections containing various products proportioned so as to automatically achieve a dermatologic or cosmetic treatment without causing habituation but by further granting the efficiency of the active principles of the products.

To this end the packing system of the invention provides an arranging in layers within the same container two or more products in the same or different quantity, however being different as composition and/or doses of active substances as for type, colours, smell, taste, flavour, and so on, the stratified products being delivered and used consecutively to either alternate the use thereof or to employ products containing active substances of progressively greater concentration.

Further details of this invention will become apparent from the following description with reference to the accompanying indicative and not limitative drawing, in which.

Figure 1:
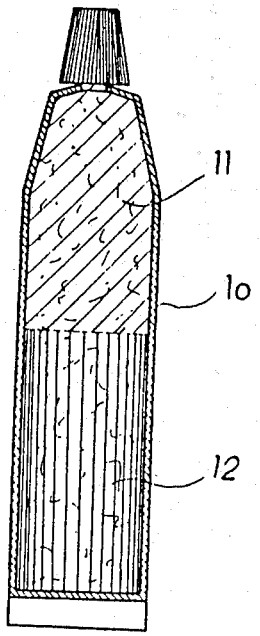
FIG. 1 shows a section of a container made up with two products.

Dermatologic and cosmetic products of daily and continuous use, like for example day and night creams, eye-cream, regenerating creams for sensitive and couperose-affected skin, hardening, shrinking, anti-cellulitis products for the body, tooth pastes for the oral hygiene and the care of the teeth and gums, are contained in confections 10 (FIG. 1) containing at least two separate products 11–12 in the same or different quantity but being different as active substancea aiming at the same dermatologic or cosmetic purpose.

The two or more products 11–12 contained in the same container can be different both as for active substances and type, appearance, smell, colour and, in case of products for the oral hygiene, taste and flavour, in order to make a visual, olfactory and gustatory distinction.

Considering, for example, a cosmetic product which is continually used every day such as a revitalizing night-cream, two creams separate from each other, for example the first white, the second pink, are filled in the same container such as a metallic or plastic tube essentially in the same quantity, each of them, however, being composed of qualitatively different revitalizing substances.

In this way two different creams are delivered one after the other, for example, the white cream first, and then the pink cream when the white is over.

When the pink cream also is over, a new tube of regenerating night-cream will be applied so as to still deliver the white cream first, and then the pink cream a.s.o.

In this way an alternate use of different products is granted so that the skin is not allowed to accustom itself to the different active substances contained in both creams, thus avoiding the habituation.

A similar packing system can be also provided for dermatologic and cosmetic products of periodic use, for example, for a treatment of two to eight applications in a period of one year with revitalizing, regenerating, anti-wrinkling, hardening, shrinking, impact or shocking substances, and anti-vibex, anti-cellulitis products as well as special tooth pastes for the care of teeth and gums.

As above mentioned, organism accustoms itself to the concentration or dose of the active principle so that greater and greater doses are needed to achieve and keep the same initial effect. Furthermore the habituation is transitory.

Figure 2:
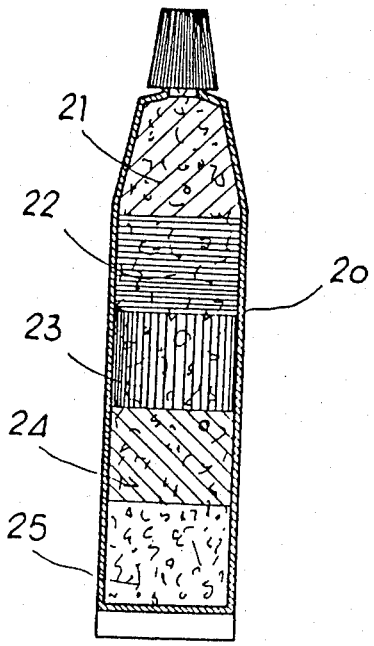
FIG. 2 is a similar view of a container made up with a plurality of layers of different products.

Thus in case of a treatment of progressively increasing intensity more equal or different layers 21, 22, 23, 24, 25 of a product having an increasing concentration of active principles from the first to the last one are filled in the same container 20 (FIG. 2).

Therefore a product in stronger and stronger doses or concentrations is delivered from only one container to avoid the habituation of the body. In the course of the treatment a change in the colour intensity of the product, for example from white to deep pink, indicates visually the progressive increase of the doses of active substances.

I claim:

1. A packing system for habituation-free use of products having an active component dispensed from containers for topical dermatological or cosmetic application to the skin, such as emulsions, creams, unguents, pastes, slaves, gels, lipogels and the like, comprising a container having more than two successive layers of said product containing the same active component, each successive layer having a progressively increasing concentration of said active component, said layers being arranged for delivery from said container in order of said active component concentration to prevent habituation of said skin to said component.

2. The packing system of claim 1 wherein said layers are arranged for delivery in increasing order of said active component concentration from the first to the last layers.

3. The packing system of claim 2 wherein said layers have different color intensities to indicate the progressive increase of said active component.

4. A packing system for habituation-free use of products having one or more active components dispensed from containers for topical dermatological or cosmetic application to the skin, such as emulsions, creams, unguents, pastes, slaves, gels, lipogels and the like, comprising a container having a plurality of successive layers of said product, each successive layer containing a different active component, each of the different active components having the same dermatological or cosmetic purpose, said layers being arranged for delivery from said container to provide said different active components in sequence to the skin to prevent habituation of said skin to said components.

5. The packing system of claim 4 wherein said layers contain two different active components arranged for alternate delivery from said container.

6. The packing system of claim 5 wherein one of said active components is of vegetable origin and the other of said active components is of animal origin.

* * * * *